United States Patent [19]

Rymarchyk, Jr.

[11] 4,052,005

[45] Oct. 4, 1977

[54] OXYGEN LANCE NOZZLE

[75] Inventor: Nicholas M. Rymarchyk, Jr., Pittsburgh, Pa.

[73] Assignee: Berry Metal Company, Harmony, Pa.

[21] Appl. No.: 665,841

[22] Filed: Mar. 11, 1976

[51] Int. Cl.[2] ..... B05B 15/00

[52] U.S. Cl. ..... 239/132.3; 266/225

[58] Field of Search ..... 239/127.1, 132, 132.1, 239/132.3, 132.5, 133, 134; 266/34 L

[56] References Cited

U.S. PATENT DOCUMENTS

| | | | |
|---|---|---|---|
| 3,302,882 | 2/1967 | Hutton | 239/132.3 |
| 3,304,009 | 2/1967 | Hutton | 239/132.3 |
| 3,385,587 | 5/1968 | Smith | 239/132.3 |
| 3,430,939 | 3/1969 | Berry | 266/34 L |
| 3,531,097 | 9/1970 | Paulina | 239/132.3 |
| 3,662,447 | 5/1972 | Schweng et al. | 239/132.3 X |

*Primary Examiner*—Evon C. Blunk

*Assistant Examiner*—Michael Mar

*Attorney, Agent, or Firm*—Richard J. Myers

[57] ABSTRACT

An oxygen lance tip or nozzle for Basic Oxygen Furnace Operations includes a body having an oxygen discharge means. The tip or nozzle is connected to a central oxygen pipe and two outer concentric pipes provide water inlet and outlet passageways communicating with an outer annular water chamber in the tip or nozzle. The tip or nozzle which may be a forging, includes water cooling channels individually isolated with respect to the central walls of the lance tip or nozzle, each of the channels being arranged in essentially a U-shaped configuration to provide a directional change of water flow from the water inlet passageway to the internal cooling area. Walls of the channels formed with essentially flat surfaces which consists of inserts or baffles supported on an outer ring which regulates by-passing water and separates the water inlet and outlet passages.

27 Claims, 11 Drawing Figures

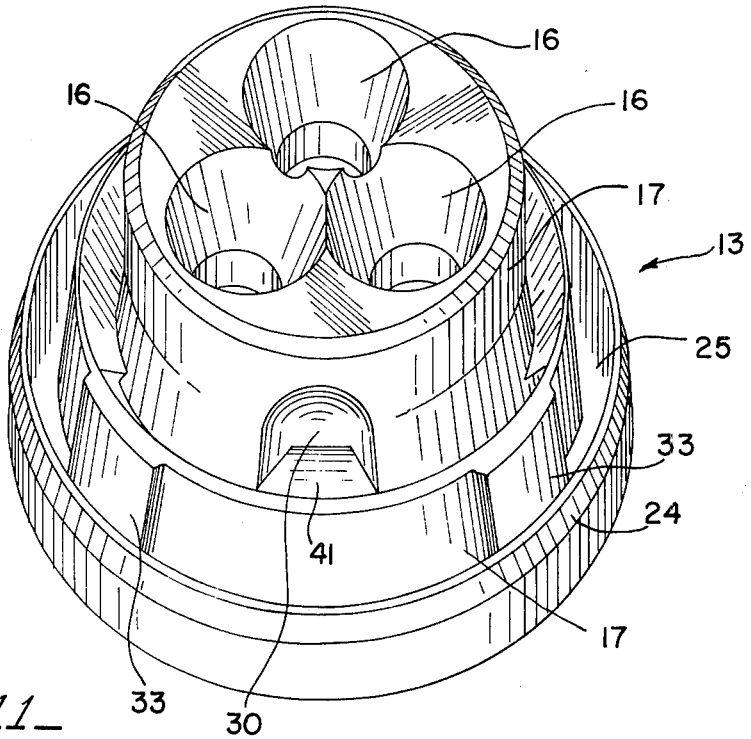
FIG. 11
FIG. 10
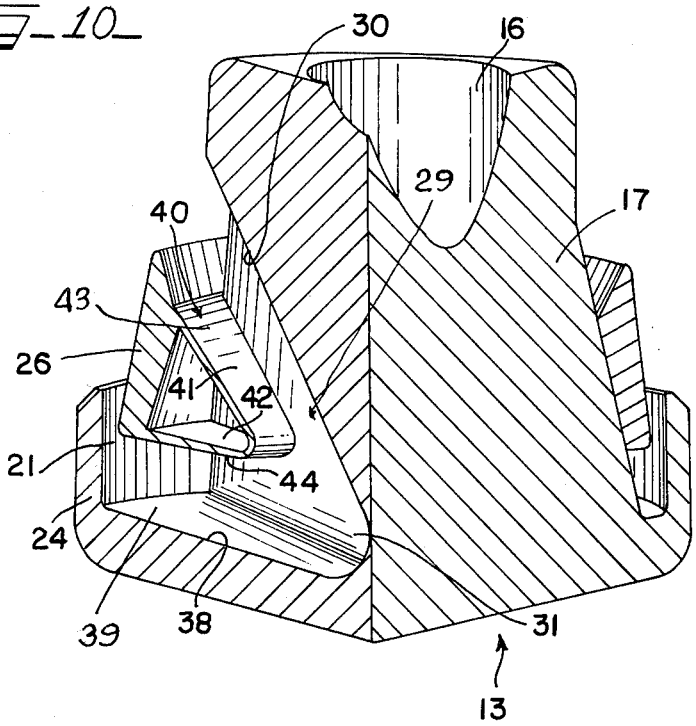

OXYGEN LANCE NOZZLE

BACKGROUND OF THE INVENTION

1. Field of the Invention

The invention relates to a lance having an improved tip or nozzle utilized in the art of steel making, other refining processes, oxygen injection, and particularly to the method known as the basic oxygen furnace operation. The present invention relates particularly to a forged and machined copper nozzle, but may also apply to a cast tip of similar configuration.

2. Description of the Prior Art

The prior art concerned particularly with forged and machined copper tips or nozzles includes designs of water cooling and by-pass arrangements which are arranged to create an optimum velocity within the passages which is intended to provide for greater cooling efficiency in the critical areas of heat transfer thereby increasing the useful life of the nozzle during steel making operations. Most of the designs of the prior art include a central communicating chamber within the nozzle tip which the individual water passages communicate and a high degree of turbulence results. However, by virtue of these designs and the central communicating chamber, a local decrease in the velocity flow also occurs which is highly undesirable in the heat transfer is decreased and the benefit of the high velocity cooling is thus greatly reduced. In the present design, the optimum velocity is attained while minimizing the turbulence which is the most desirable arrangement to guarantee proper cooling and thus insuring long life of the tip or nozzle.

SUMMARY OF THE INVENTION

The present invention may be utilized with all types of copper nozzles having one or more oxygen ports and is particularly well adapted to the forged type of tip. The nozzle includes a cylindrical body having one or more circumferentially disposed oxygen discharge orifices communicating with a central concentric oxygen passage. A lower circumferentially extending vertical flange is connected to an outer conduit providing a water outlet passage. A ring-shaped member is connected to the body of the nozzle and is connected to a concentric pipe forming between the body a water inlet passage which communicates with a water chamber disposed at the lower end of the flange and body. A plurality of water by-pass bore means are provided for circulating water from the inlet passages to the water chamber and through the outlet passages. Each of the by-pass means comprises an inwardly and downwardly extending diagonal bore having a lower terminal end which is isolated from the other bore means by means of a central wall portion of the body. The terminal end of each of the diagonal bores is connected to diverging outlet bores which in turn communicate with the water chamber. The outlet bores are arranged with the inlet bores in V-shaped configuration whereby an abrupt change in direction is provided as the water leaves the lower terminal point of the diagonal bores and is directed outwardly through the outwardly extending discharge bores which communicate with the water chamber. The lower outlet bores are provided with a flat lower wall surface which greatly enhances their cooling function.

BRIEF DESCRIPTION OF THE DRAWINGS

FIG. 10 is a cross-sectional view similar to FIG. 5 showing a modified baffle arrangement forming water by-pass arrangements of the nozzle;

FIG. 11 is a perspective view similar to FIG. 7 of the modified nozzle shown in FIG. 10.

DESCRIPTION OF THE PREFERRED EMBODIMENT

Figure 1:
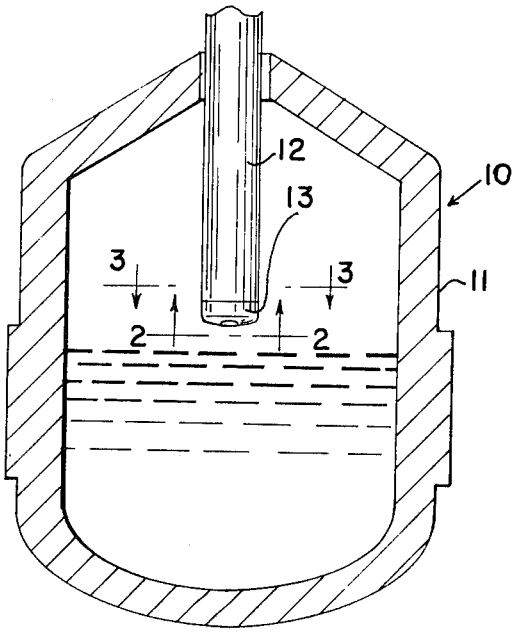
FIG. 1 is a cross-sectional view through a basic oxygen vessel having an oxygen lance including a nozzle or tip projecting therein.
Figure 2:
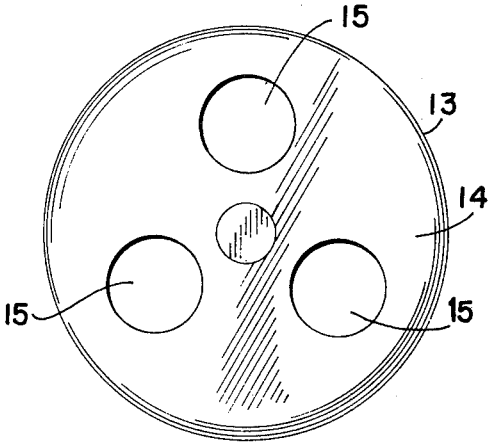
FIG. 2 is an enlarged bottom view taken substantially along the line 2—2 of FIG. 1.
Figure 7:
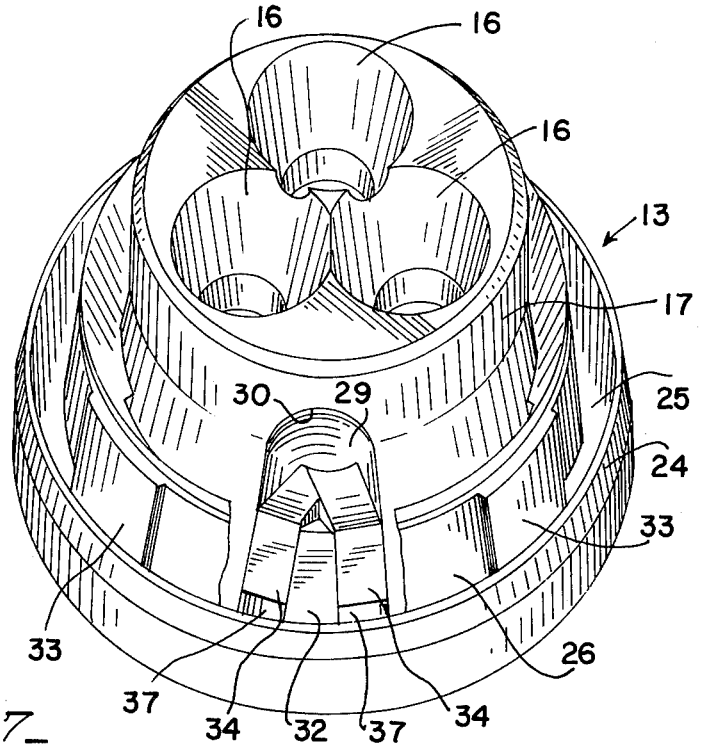
FIG. 7 is a perspective view looking downwardly on the improved nozzle or tip.

Referring to FIG. 1 a basic oxygen furnace 10 comprises a vessel 11 which includes a downwardly projecting oxygen lance 12 having a lower oxygen tip or nozzle 13. The furnace 10 is used in the well-known and conventional basic oxygen process for refining steel. The nozzle 13 comprises a lower cylindrical face 14 having a plurality of oxygen ports 15 which provide outlets for diverging and converging oxygen passages 16.

Figure 5:
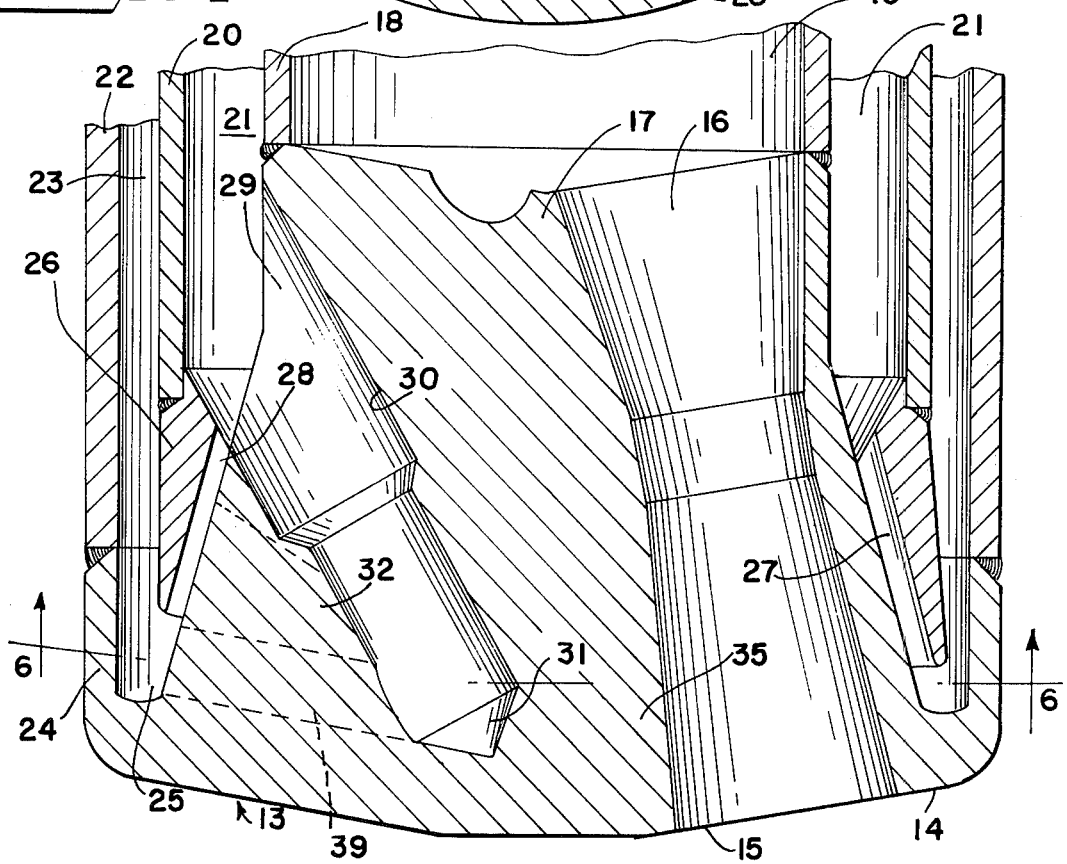
FIG. 5 is a cross-sectional view taken substantially along the line 5—5 of FIG. 3.

Referring particularly to FIGS. 3–7, the body 17 of the nozzle 13 is of a cylindrical and frusto-conical design. The lance 12 includes a central conduit 18 which is connected to the body 17, the said conduit 18 including an oxygen passage 19 which communicates with the oxygen passages 16 for directing oxygen to the bath provided in the vessel 11. As shown in FIG. 5 a first inner concentric conduit 20 provides a water or coolant inlet passage 21 and a second outermost coolant conduit 22 provides a water outlet passage 23.

Figure 3:
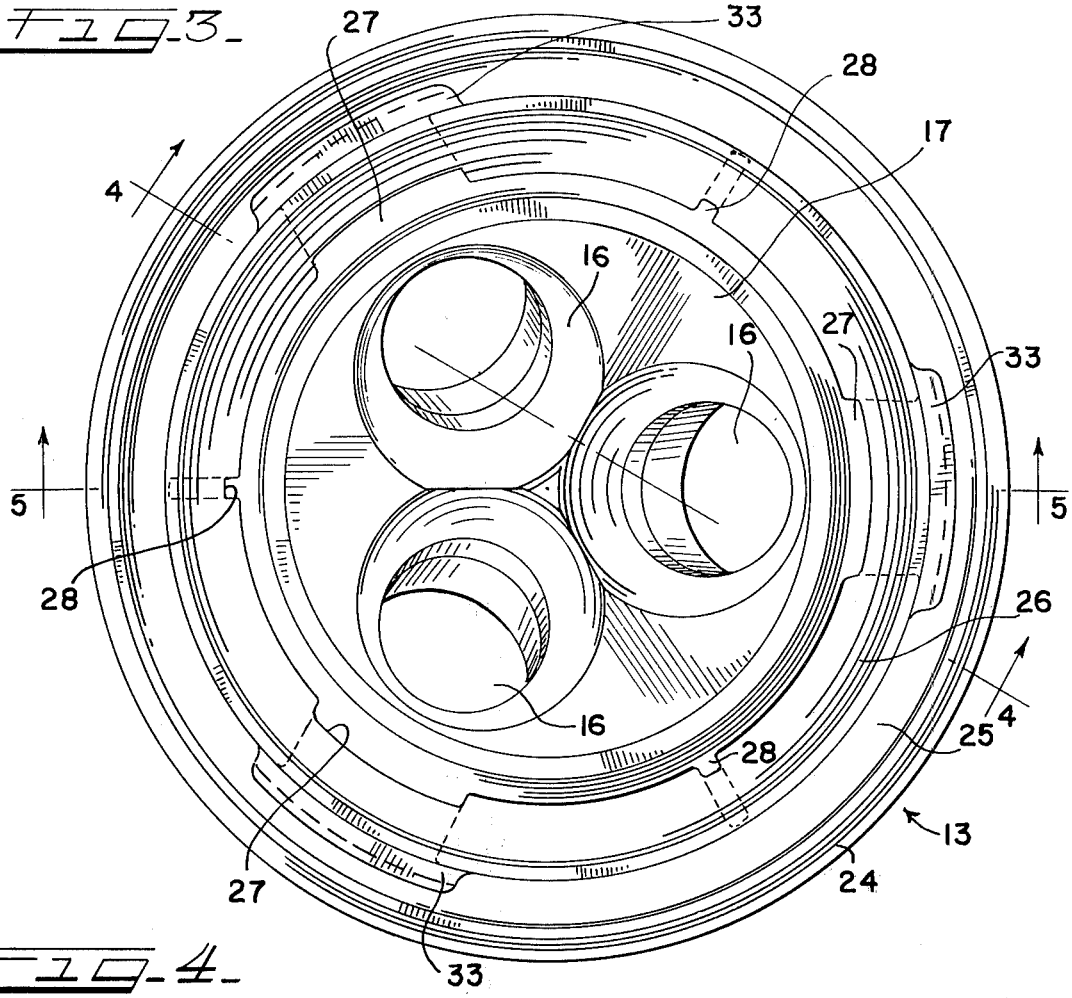
FIG. 3 is a cross-sectional view through a lower portion of the lance taken substantially along the line 3—3 of FIG. 1.
Figure 4:
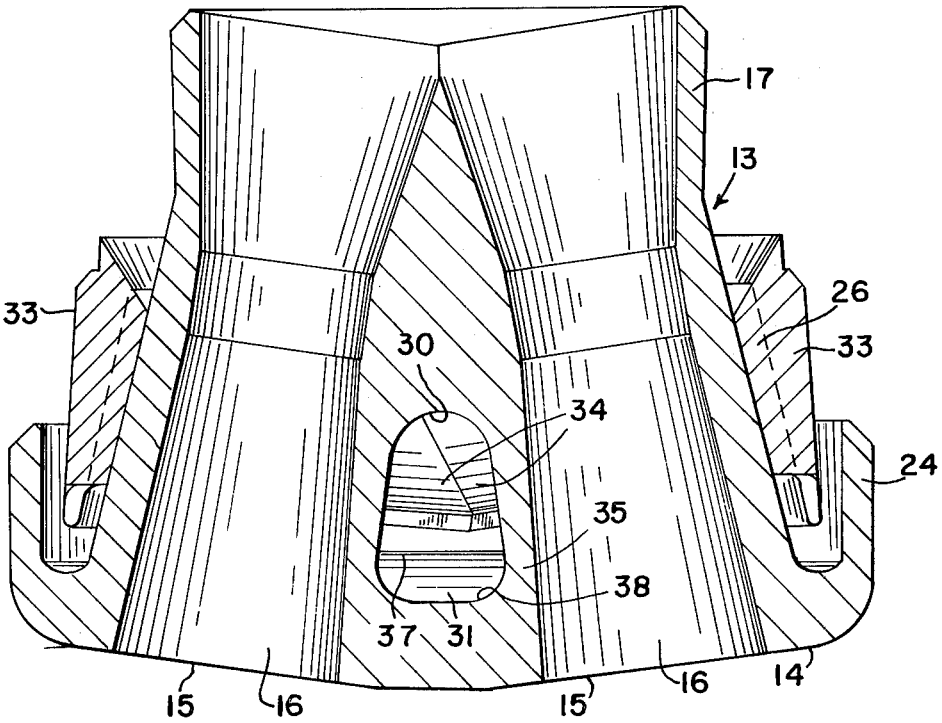
FIG. 4 is a cross-sectional view taken substantially along the line 4—4 of FIG. 3.
Figure 6:
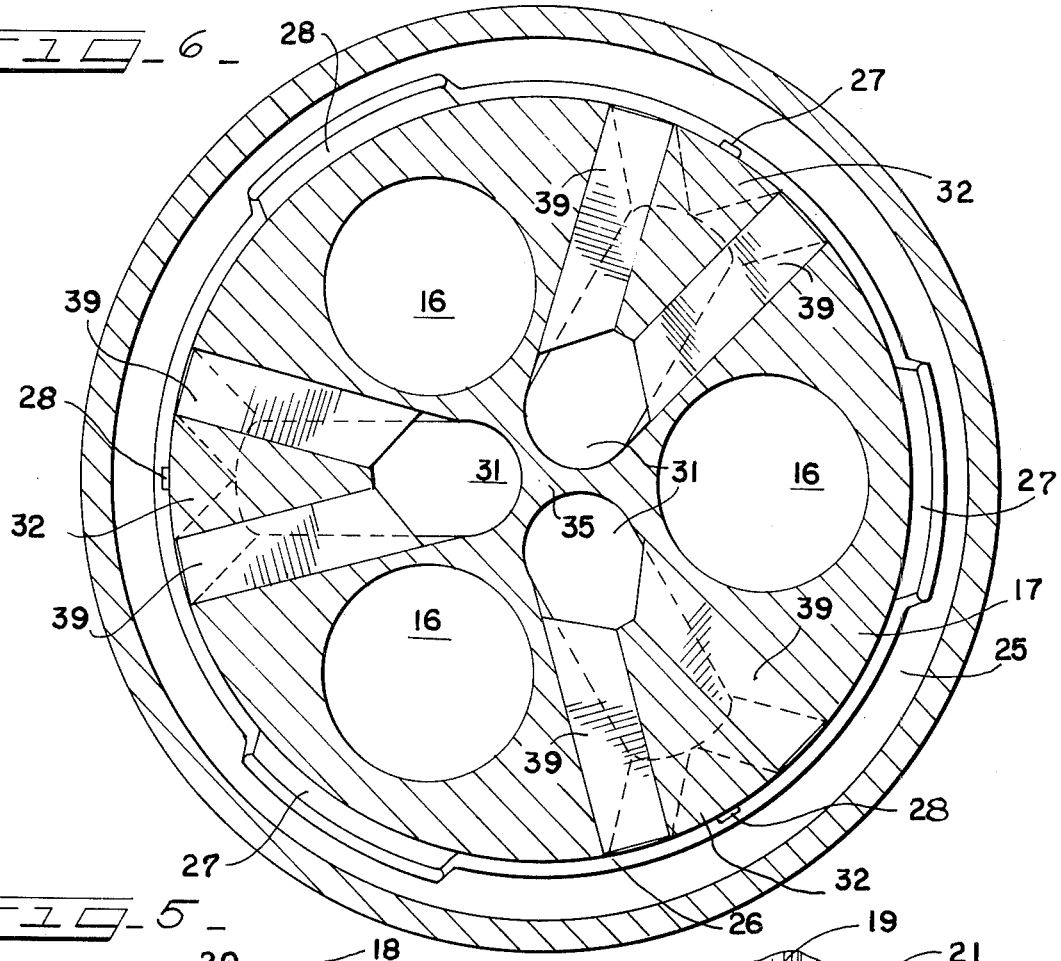
FIG. 6 is a cross-sectional view taken substantially along the line 6—6 of FIG. 5.

The lower end of the body 17 is provided with a laterally spaced circumferential flange 24 forming at the lower end thereof a water chamber 25. The circumferential flange 24 is welded to the second outermost conduit 22 in the assembly of the lance and nozzle. A ring providing a water separator or shelf 26, when assembled with the body 17, provides large by-pass passages 27 and small by-pass passages 28 which provide for direct communication between the water inlet passage 21 and the water chamber 25. As best shown in FIGS. 3 and 6, the passages 27 and 28 are circumferentially spaced around the body 17. As best shown in FIGS. 5, 6, 7 and 8, the body 17 is provided with a plurality of downwardly and inwardly extending diagonal inlet bores 29 spaced between each of the oxygen passages 16. Each diagonal inlet bore 29 includes an upper arcuate wall 30 and is provided at its lowermost end with a terminal lower portion 31 with each of the lower portions 31 being separated by a central wall portion 35 as best shown in FIG. 5.

Figure 8:
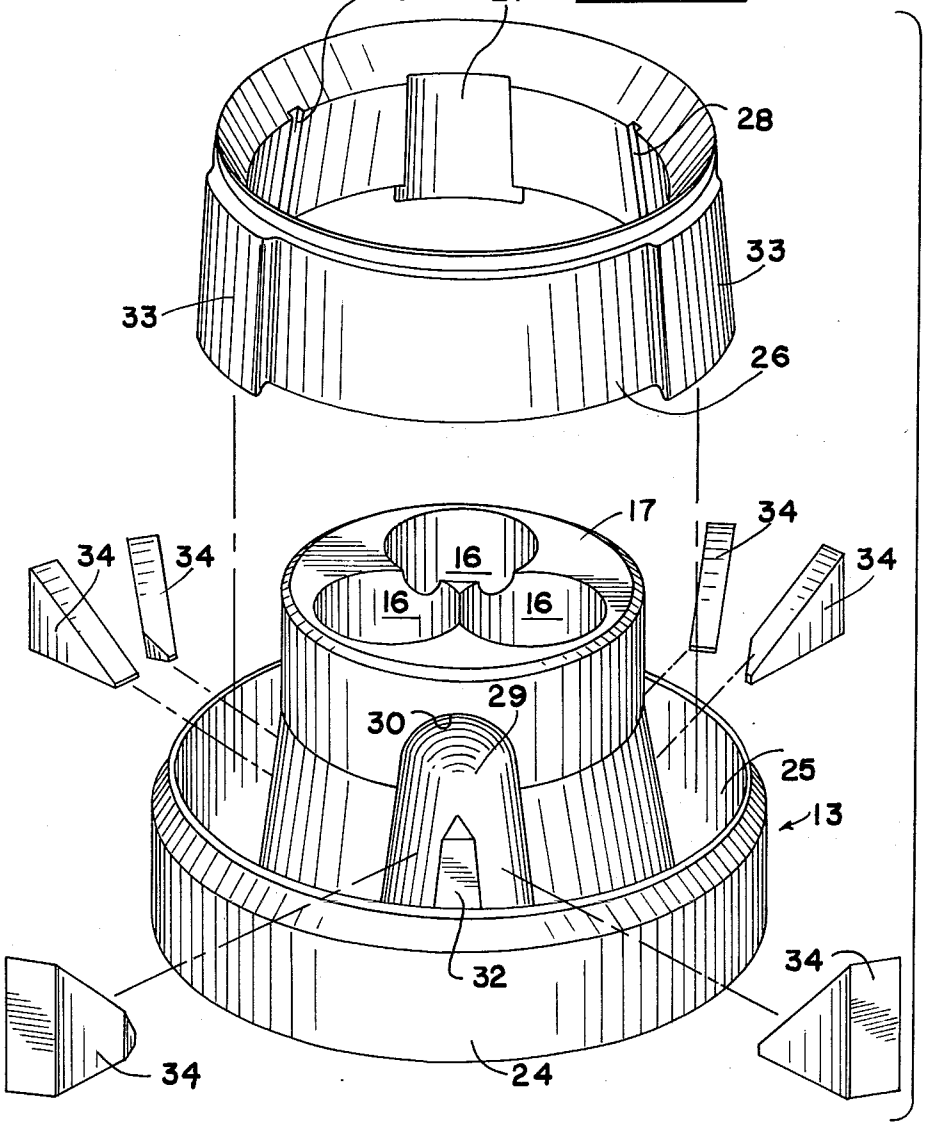
FIG. 8 is an exploded perspective view of a nozzle showing a ring adapted to be supported on a nozzle and including a plurality of inserts adapted to be assembled thereby forming water by-pass bore arrangements.

Describing now more specifically the water by-pass means which includes the diagonal inlet bores 29, a V-shaped divider wall 32 is positioned below the upper arcuate walls 30. A plurality of V-shaped inserts 34, as best shown in FIGS. 1 and 8, are positioned in wedged relation within the cavity forming the diagonal bore 29 and being separated by the divider wall 32. When the ring 26 is in the lowered assembled position, as shown in FIG. 5, it retains the inserts 34 in the position shown in FIG. 7. The ring 26 is also provided with outwardly projecting ledges 33, best shown in FIGS. 3 and 4. The large by-pass passages 27 are located immediately outwardly of the oxygen passages 16 in the body 17, whereas the smaller passages 28 are located immediately outwardly of the V-shaped divider walls 32, as best shown in FIG. 6.

Figure 9:
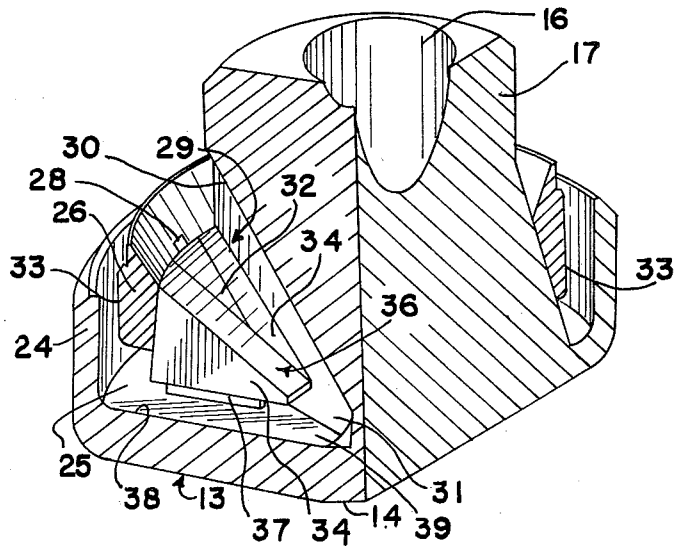
FIG. 9 is a view of a nozzle segment showing a portion thereof in section to disclose the arrangement of a by-pass bore.

As best shown in FIG. 9, the inserts 34 are flat on the top and thus provide, in the assembled position, a lower flat wall for the diagonal bore 29. Also, the lower portions of the inserts 34 are flat to provide an upper flat wall 37 for outlet passages 39. When the cavities forming the by-pass means are formed in the manufacturing operation the body is subjected to a machining operation which provides a flat surface for walls 38 for each of the outlet passages 39. This is best shown in FIG. 9. Thus the inserts 34 by virtue of their V-shaped configuration, provide a lower flat wall for the upper diagonal bore 29 and an upper flat wall for the outlet passages or bores 39.

Referring now particularly to the modification shown in FIG. 10, the ring-shaped shelf 26 supports a V-shaped baffle 40 provided for each of the by-pass means. Each baffle 40 includes flanges 41 and 42 secured to the ring 26 and supported thereon, the said baffle 40 providing the lower flat wall 43 for the upper bore 29 and the flange 42 providing the upper flat wall 44 for the outlet passages 39. As best shown in FIG. 6, each of the outlet passages 39 diverges outwardly from the terminal end 31 of each of the upper bores 29.

THE OPERATION

In the operation, oxygen at high velocities is directed through the oxygen passage 19 to the diverging-converging oxygen passages 16 and outwardly from the oxygen ports 15 onto the bath contained within the vessel 11. Cooling water is directed downwardly through the water inlet passages 21 through the diagonal bore 29 outwardly through the passages 39 into the water chamber 25 and upwardly outwardly through the water outlet passage 23. Water also flows through the by-pass passages 27 and 28 from the water passage 21 to the water chamber 25. In the present invention the arrangement of the by-pass bores in such that the highest turbulence obtainable occurs, which is the most desirable condition to dissipate the heat from within the nozzle body. In addition to the high turbulence desired, it is also of the highest advantage to have an increased velocity which occurs at the terminal point 31 wherein the abrupt change in direction directs the water outwardly through the passages 39. By virtue of the double arrangement of the passages 39, a higher rate of heat transfer occurs. Thus in the present design, the highest turbulence plus the highest velocity is achieved to secure maximum cooling of the nozzle. In the manufacture of the nozzle tip, the cavities are initially bored to provide the passages 29 and the divider wall 32 is machined in the forgoing. The outlet passages 39 are also machined and when the segments 34 are inserted the configuration of the passages is complete, thus providing for the desired configuration with the most expeditious manufacturing technique. The segments can be located freely in the cavity or they may be tack welded. In either event the ring 26 positions them against dislocation. The abrupt change in direction provided at the terminal point or head area 31 of the by-pass means is particularly significant to secure the highest velocity and turbulence. Since each of the by-pass means are separated by the wall portion 35 greater heat dissipation and cooling occurs. Also, the lower flat walls of the passages 39 with the passages return being generally rectangular provided for greater surface area of each of the passages, thus having a greater cooling efficiency to cool the nozzle during operation.

In the modification shown in FIG. 10, the water by-pass or return means is formed by means of the baffles which are secured to the ring and which provide the lower and upper flat surfaces of the bores and passages respectively. Thus again the flat areas provided increases the cooling efficiency of the nozzle.

The present forged tip design offers unique advantages in that the water by-pass passages do not meet at the critical face area of the tip but are separated by a relatively thin central wall portion 35 as best shown in FIG. 6. This forms a cooling fin to increase the heat transfer surface thus providing greater cooling efficiency.

Also the water exit through the lower discharge bores is basically rectangular in cross-section because of the end milling operation and also because of the shape of the inserts or baffles. Also, two water outlets are provided for each water entrance thus creating a common cooling fin. The advantages of the rectangular profile offers a greater heat transfer surface for cooling the tip face with a shorter path than that of an equivalent heat transfer surface of a circular profile defined by the same width. The prior art does not in any manner disclose the rectangular profile and thus the cooling efficiency is not as great in the designs of the prior art. Further, the inserts and baffles used to fill the voids which have been created by end milling operation act as control means to regulate the velocities across the tip face. Further, the fabrication of the by-pass passages by the utilization of the inserts and the baffles permits a more efficient manufacture which eliminates the plug welding of holes and specialized welding at critical locations. Thus local and mechanical stresses in the body of the tip are greatly minimized by the present fabrication.

From the foregoing it is apparent that the present invention includes the following features:

1. The separate cooling passages precludes the formation of a highly turbulent region.

2. The "cooling fin", 35, formed by milling the water channel, conducts the heat to the coolant, to effect the nucleate boiling process.

3. The larger area of the lance tip inter-surface maximizes nucleate boiling/forced-convection heat transfer and minimizes the less efficient film boiling/conductive heat transfer.

4. The configuration of inserts, 34, provide for optimim capability to set the design to specific conditions by regulating the water velocity through the critical outlet passage, 39.

5. The water by-pass channel, 27, introduces the coolant to an otherwise vacant low velocity area behind the oxygen "leg", 16. It also prevents turbulence as created by the jointure of the cooling water exiting from passage, 39, into the outer chamber, 25.

6. The water by-pass slot 28, introduces the coolant to an otherwise vacant low velocity area that is formed as the cooling water exiting from passage, 39, begins to divide as it enters the outer chamber, 25.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. For a gas blowing lance having a central gas conduit, a first water coolant conduit concentrically positioned in laterally spaced relation with respect to said central conduit to provide a first cooling passage, and a second water coolant conduit concentrically positioned in laterally spaced relation relative to said second conduit to provide a second cooling passage, the improvement comprising;

a nozzle tip having a cylindrical body connected to said conduits and provided with a lower face, gas passage means extending substantially vertically within said body communicating with said central gas conduit, said gas passage means including opening means in said cylindrical face, a circumferentially extending flange formed at the lower portion of said body extending vertically upwardly and spaced radially outwardly from said body to provide a cylindrical water chamber about the lower portion of said body, said second conduit being connected to said flange to provide communication between said second cooling passage and said cylindrical water chamber, a ring-shaped shelf supported on said cylindrical body and projecting radially outwardly with respect thereto, said shelf being connected to said first conduit and having vertical passage means in communication with said first cooling passage and said water chamber, water by-pass means in said body including inlet bore means communicating with said first water passage extending from the upper portion of said body diagonally inwardly and downwardly, and outlet passage means in said body communicating with said inlet bore and extending radially outwardly and directly communicating with said cylindrical water chamber below said ringshaped shelf, said outlet passage means including means for effecting nucleate boiling of the water to maximize heat transfer thereto.

2. The invention in accordance with claim 1, said inlet bore means and outlet passage means radially extending and of V-shaped configuration providing an abrupt change of liquid flow at the apex of said V-configuration.

3. The invention in accordance with claim 1, said outlet passage means including two passages extending radially in diverging relation.

4. The invention in accordance with claim 1, and said nucleate boiling means including substantially flat walls defining said outlet passage means.

5. The invention in accordance with claim 1, said opening means in said face including a plurality of gas outlets, and said body including a central vertical portion forming a wall separating said gas outlets disposed in a region of convergence of said gas outlets for effectuating balanced heat transfer to the coolant.

6. The invention in accordance with claim 5, said bore means including a plurality of bores, each passage means comprising two passages and each bore being connected to two of said passages, and said central vertical portion of said body and wall separating said bores and outlet passages, and means for turbulating the coolant in said cylindrical water chamber.

7. The invention in accordance with claim 1, said inlet bore and outlet passage means radially extendng and of V-shaped configuration providing an abrupt change of liquid flow at the apex of said V-configuration and said inlet bore means and outlet passage means having a juncture of enlarged cross-section and providing a relatively large heat transfer surface area adjacent to a gas passage and said outlet passage means having water velocity modulating shapes.

8. For a gas blowing lance having a central gas conduit, first water conduit concentrically positioned in laterally spaced relation with respect to said central conduit to provide a first cooling passage, and a second water conduit concentrically positioned in laterally spaced relation relative to said second conduit to provide a second cooling passage, the improvement comprising;

a nozzle tip having a cylindrical body connected to said conduits and provided with a lower face, gas passage means extending substantially vertically within said body communicating with said central gas conduit, said gas passage means including opening means in said cylindrical face, a circumferentially extending flange formed at the lower portion of said body extending vertically upwardly and spaced radially outwardly from said body to provide a cylindrical water chamber about the lower portion of said body, said second conduit being connected to said flange to provide communication between said second cooling passage and said cylindrical water chamber, a ring-shaped shelf supported on said cylindrical body and projecting radially outwardly with respect thereto, said shelf being connected to said first conduit and having vertical passage means in communication with said first cooling passage and said water chamber, water by-pass means in said body including inlet bore means communicating with said first water passage extending from the upper portion of said body diagonally inwardly and downwardly, and outlet passage means in said body communicating with said inlet bore and extending radially outwardly and directly communicating with said cylindrical water chamber below said ring-shaped shelf, said inlet bore and outlet passage means being positioned in relatively V-shaped configuration providing an abrupt change of liquid flow at the apex of said V-configuration, said outlet passage means including two passages extending radially in diverging relation, said outlet passages having substantially flat lower walls, said bore means and two passages being formed by a bore cavity having an upper arcuate wall portion, and insert means secured within said cavity spaced vertically from said arcuate wall portion to provide a lower wall for said bore means, and said insert means having lower portions vertically spaced from said lower walls of said passages to provide the top walls of said passages.

9. The invention in accordance with claim 8, said cavity including a centrally disposed separator wall integral with said body, and said insert means including a pair of inserts with one of said inserts on each side of said separator wall.

10. The invention in accordance with claim 9, said vertical passage means of said shelf extending vertically contiguous to said divider wall.

11. The invention in accordance with claim 10, said vertical passage means including wide and narrow passages positioned in sequence about said shelf, with said narrow passage being contiguous to said divider walls.

12. For a gas blowing lance having a central gas conduit, a first water conduit concentrically positioned in laterally spaced relation with respect to said central conduit to provide a first cooling passage, and a second water conduit concentrically positioned in laterally spaced relation relative to said second conduit to provide a second coolng passage, the improvement comprising;

a nozzle tip connected to said conduits and having a cylindrical body, generally axial oxygen passage means communicating with said gas conduit and having discharge openings in said face, a circumferentially extending flange formed on the lower portion of said body extending inwardly from the adjacent end and spaced radially outwardly from said body to provide a cylindrical water chamber about the adjacent portion of said body, said second conduit being connected to said flange to provide communication between said second cooling passage and said cylindrical water chamber, a ring-shaped shelf supported on said cylindrical body and projecting radially outwardly with respect thereto, said shelf being connected to said first conduit and having first passages in communication with said first cooling passage and having second passages connected to said water chamber, said first passages extending axially and inwardly into the body, the lower ends of said first passages being spaced and isolated from one another by a common central wall portion of said body, outlet bore means connected to the lower portions of said first passages and extending laterally outwardly and providing an abrupt change of direction from the first passages for liquid passing therethrough, said outlet bore means communicating with said water chamber and means comprising said second passages for directing water into said water chamber for creating turbulance.

13. The invention in accordance with claim 12, said said bore means comprising a pair of passages and said second passages disposed between said pair of passages.

14. The invention in accordance with claim 13, said pair of passages extending outwardly toward said water chamber in diverging relation and other of said second passages being circumferentially spaced between said bore means.

15. The invention in accordance with claim 14, said passages each having flat face means for effecting nucleate fluid actively and thereby effective heat transfer.

16. For a gas blowing lance having a central gas conduit, a first water conduit concentrically positioned in laterally spaced relation with respect to said central conduit to provide a first cooling passage, and a second water conduit concentrically positioned in laterally spaced relation relative to said second conduit to provide a second cooling passage, the improvement comprisng;

a nozzle tip connected to said conduit and having a cylindrical body, a plurality of generally vertical oxygen passages communicating with said gas conduit and having discharge openings in said face, a circumferentially extending flange formed on the lower portion of said body extending vertically upwardly and spaced radially outwardly from said body to provide a cylindrical water chamber about the lower portion of said body, said second conduit being connected to said flange to provide communication between said second cooling passage and said cylindrical water chamber, a ring-shaped shelf supported on said cylindrical body and projecting radially outwardly with respect thereto, said shelf being connected to said first conduit and having a vertical passages in communication with said first cooling passage and said water chamber, a plurality of water by-pass passages circumferentially spaced in said body, each including in a downwardly and inwardly extending first bore, the lower ends of said bores being spaced and isolated from one another by a central wall portion of said body, said by-pass passages further including outlet bore means connected to the lower portions of said bores and extending laterally outwardly and providing an abrupt change of direction for liquid passing therethrough, said bore means communicating with said water chamber, said first bores each having an upper arcuate wall and a lower wall, and said outlet bore means each including a lower bore having an upper wall and a lower wall, said lower wall of said first bores and said upper wall of said lower bores being formed by baffles supported within said body between said bores.

17. The invention in accordance with claim 16, said baffles being connected to said shelf.

18. The invention in accordance with claim 17, each said baffle having V-shaped configuration.

19. The invention in accordance with claim 18, said lower walls of said first bores and said upper and lower walls of said lower bores having a flat configuration.

20. In a gas blowing lance having gas conduit means therein, and liquid coolant inlet and outlet means about said conduit, a nozzle tip having a body with gas passage means extending therethrough from the gas conduit means, a perimetric coolant liquid chamber in said body communicating with the outlet means, by-pass passage means in the body for directing liquid coolant from the inlet means into said chamber to effectuate turbulent flow of fluid therein, and coolant passage means in the body having an inlet portion leading from the said inlet means to a region proximate said gas passage means and having an abruptly angled return portion communicating with the turbulent region of said perimetric liquid chamber.

21. The invention according to claim 20, and said passage means having an enlarged coolant head section in the vicinity of the gas passage means and said return portion comprising a plurality of branches collectively of different volumetric dimension then said inlet portion for changing the flow characteristics of the water away from said head section.

22. The invention according to claim 20, and said gas passage means comprising a plurality of gas passages, and said by-pass passage means including a passage in radial alignment with each passage means.

23. The invention according to claim 20, and said by-pass passage means including a plurality of passages circumferentially spaced about said body and certain of said last-mentioned passages being radial alignment with the inlet portions of the coolant passages and other of the last-mentioned passages being in radial alignment with respective gas conduit means comprising a plurality of bores through said nozzle tip.

24. The invention according to claim 20, and flat faced inserts in said body providing flat sides for said return passage portions for ablating contact by the fluid flowing therethrough.

25. The invention according to claim 24, and said inserts subdividing said return portions into a plurality of branches.

26. The invention according to claim 25, and said branches diverging from the juncture of the inlet and return portions as furcations toward the liquid chamber and certain of said passages of the by-pass passage means disposed within said furcations.

27. The invention according to claim 20, and said return portions having at least certain of its sides flat faced.

* * * * *